US008205748B2

(12) United States Patent
Long et al.

(10) Patent No.: US 8,205,748 B2
(45) Date of Patent: Jun. 26, 2012

(54) REFILL CARTRIDGES OF A FOLDED TISSUE PRODUCT

(75) Inventors: Leslie Thomas Long, Appleton, WI (US); Jason John Schumaker, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 12/723,844

(22) Filed: Mar. 15, 2010

(65) Prior Publication Data

US 2010/0243504 A1 Sep. 30, 2010

Related U.S. Application Data

(60) Provisional application No. 61/165,200, filed on Mar. 31, 2009.

(51) Int. Cl.
*B65D 73/00* (2006.01)

(52) U.S. Cl. ..... 206/494; 206/812; 206/499; 206/223; 221/49; 221/33

(58) Field of Classification Search ..... 206/494, 206/812, 449, 554, 516, 233; 221/49, 33
See application file for complete search history.

(56) References Cited

U.S. PATENT DOCUMENTS

| | | | | | |
|---|---|---|---|---|---|
| 1,158,353 | A | * | 10/1915 | Willis | 221/49 |
| 3,066,932 | A | | 12/1962 | Greiner et al. | |
| 3,122,361 | A | | 2/1964 | Moore | |
| 3,288,327 | A | * | 11/1966 | Cahlik | 221/70 |
| 3,679,094 | A | | 7/1972 | Nissen et al. | |
| 4,555,017 | A | * | 11/1985 | Blackmore | 206/83.5 |
| 5,326,788 | A | * | 7/1994 | Meruelo et al. | 514/732 |
| 5,344,007 | A | * | 9/1994 | Nakamura et al. | 206/205 |
| 5,467,894 | A | * | 11/1995 | Altonen et al. | 221/71 |
| 5,540,354 | A | * | 7/1996 | Annand | 221/52 |
| 5,622,281 | A | | 4/1997 | Annand | |
| 5,644,897 | A | | 7/1997 | Young et al. | |
| 5,746,318 | A | | 5/1998 | Batchelor | |
| 5,868,276 | A | | 2/1999 | Loppnow et al. | |
| 6,182,418 | B1 | * | 2/2001 | McFarland | 53/411 |
| 6,250,495 | B1 | | 6/2001 | Bando | |
| 6,641,894 | B2 | * | 11/2003 | Bando | 428/126 |
| 6,820,397 | B2 | | 11/2004 | Haasl | |
| 7,377,391 | B2 | | 5/2008 | Long et al. | |
| 2002/0139811 | A1 | | 10/2002 | Tramontina et al. | |
| 2003/0116581 | A1 | | 6/2003 | Schmidt et al. | |
| 2005/0189850 | A1 | * | 9/2005 | Riel | 312/34.4 |

FOREIGN PATENT DOCUMENTS

JP 2007-153383 6/2007

OTHER PUBLICATIONS

International Search Report and Written Opinion for PCT/IB2010/051113, Dated Oct. 27, 2010.

* cited by examiner

*Primary Examiner* — J. Gregory Pickett
*Assistant Examiner* — Blaine Neway
(74) *Attorney, Agent, or Firm* — Dority & Manning, P.A.

(57) ABSTRACT

An environmentally friendly package containing refill folded sheets is provided. The package contains a plurality of refill cartridges stacked together. Each refill cartridge contains a stack of interfolded sheets. In one embodiment, for instance, the sheets may comprise facial tissues. Each refill cartridge is configured to refill a sheet dispenser such as a paperboard dispenser. In this manner, a consumer can continually refill a single dispenser instead of having to repurchase a dispenser each time the folded sheet product is purchased.

23 Claims, 7 Drawing Sheets

REFILL CARTRIDGES OF A FOLDED TISSUE PRODUCT

RELATED APPLICATIONS

The present application is based upon and claims priority to U.S. Provisional Patent Application Ser. No. 61/165,200 filed on Mar. 31, 2009.

BACKGROUND

Tissue products, such as facial tissues, industrial wipers, and the like, are typically packaged in a disposable paperboard carton. The folded sheet materials within the carton or dispenser are usually configured to dispense the product one sheet at a time. In addition to dispensing the product, the cartons can also be very decorative.

Unfortunately, however, many cartons are simply discarded after the tissue product has been exhausted or emptied from the carton. Thus, not only does the carton typically end up in the solid waste stream, but the carton can represent a significant portion of the cost of the product.

The above problems become exacerbated since consumers typically prefer to buy smaller upright cartons that have a relatively small footprint in comparison to larger rectangular-shaped cartons. In fact, consumers have a tendency to buy the upright cartons even though the cartons contain significantly less sheets and are at a higher cost. The use of smaller cartons leads to manufacturer and disposal of more cartons.

Due to the above, a need currently exists for a process and product that decreases the amount of tissue box cartons consumed by consumers. Using less cartons is more environmentally friendly and would lower the overall costs of folded sheet products.

SUMMARY

In view of the above, the present disclosure is generally directed to the production of refill cartridges of a folded sheet product. Multiple refill cartridges, for instance, can be packaged and sold together and used to refill previously purchased cartons or other types of dispensers. Such refill packs reduce the cost of folded sheet products, take up less shelf space in a retail outlet in comparison to the sale of sheets contained in cartons, and ultimately lead to less pulp waste and greater conservation.

In one embodiment, for instance, the present disclosure is directed to a package of refill tissue sheets that comprises a plurality of refill cartridges of a tissue product. The tissue product, for instance, may comprise a facial tissue, a bath tissue, a paper towel, a napkin, and industrial wipe, or the like. The tissue product may comprise a substantially dry product although the product may also comprise a pre-moistened wipe.

Each refill cartridge includes a stack of sheets that are interfolded together. In accordance with the present disclosure, the plurality of refill cartridges are stacked together. Each refill cartridge is separated from an adjacent cartridge by a separating device. The separating device, for instance, may comprise a rigid piece of material, such as a panel made from a plastic or paperboard. In one embodiment, the separating device may comprise a tray that is slightly larger than the stack width of the folded sheets.

In an alternative embodiment, the separating device may comprise the use of color to separate the different cartridges. For instance, one cartridge may have an ending sheet that may have a different color than the beginning sheet of an adjacent cartridge. Additionally, the materials used to separate the different cartridges may include anti-viral components.

The separate refill cartridges are not individually wrapped or packaged. Instead, the plurality of refill cartridges are held together by a packaging material. The packaging material may comprise, for instance, a paper or a plastic film. The plurality of refill cartridges may be encased within the packaging material or, alternatively, the packaging material may comprise a band of material that extends around the center of the cartridges.

In one embodiment, each stack of sheets that comprises a cartridge can include an initial sheet having a starter fold. For example, the initial sheet may have a trifold whereas most of the remaining sheets in the stack include only bifolds. The last sheet of each cartridge is not interfolded with the first sheet of the adjacent cartridge to provide separation of each cartridge.

The number of refill cartridges that are packaged together can depend upon the particular application. In one embodiment, for instance, each package can contain from about three to about five refill cartridges. Each refill cartridge can contain at least about 50 individual sheets, such as from about 50 sheets to about 150 sheets, such as from about 70 sheets to about 100 sheets.

In one embodiment, a plurality of packages as described above can be bundled together. For example, from about two to about eight of the packages described above (each containing a plurality of refill cartridges) may be further contained in a larger package. The larger package, for instance, may be made from a polymer film and may include a handle. In this manner, a consumer can purchase more than eight refill cartridges in a single package for refilling folded sheet dispensers displayed in one's home, in one's office, or at any other convenient location.

Through the product of the present disclosure, folded sheet dispensers, such as various paperboard cartons, can be reused by simply refilling the dispensers after the folded sheet product has been exhausted. In this regard, paperboard cartons and other dispensers can be sold in conjunction with the refill cartridges that include a means for opening the dispenser for placing folded sheets within the dispenser.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
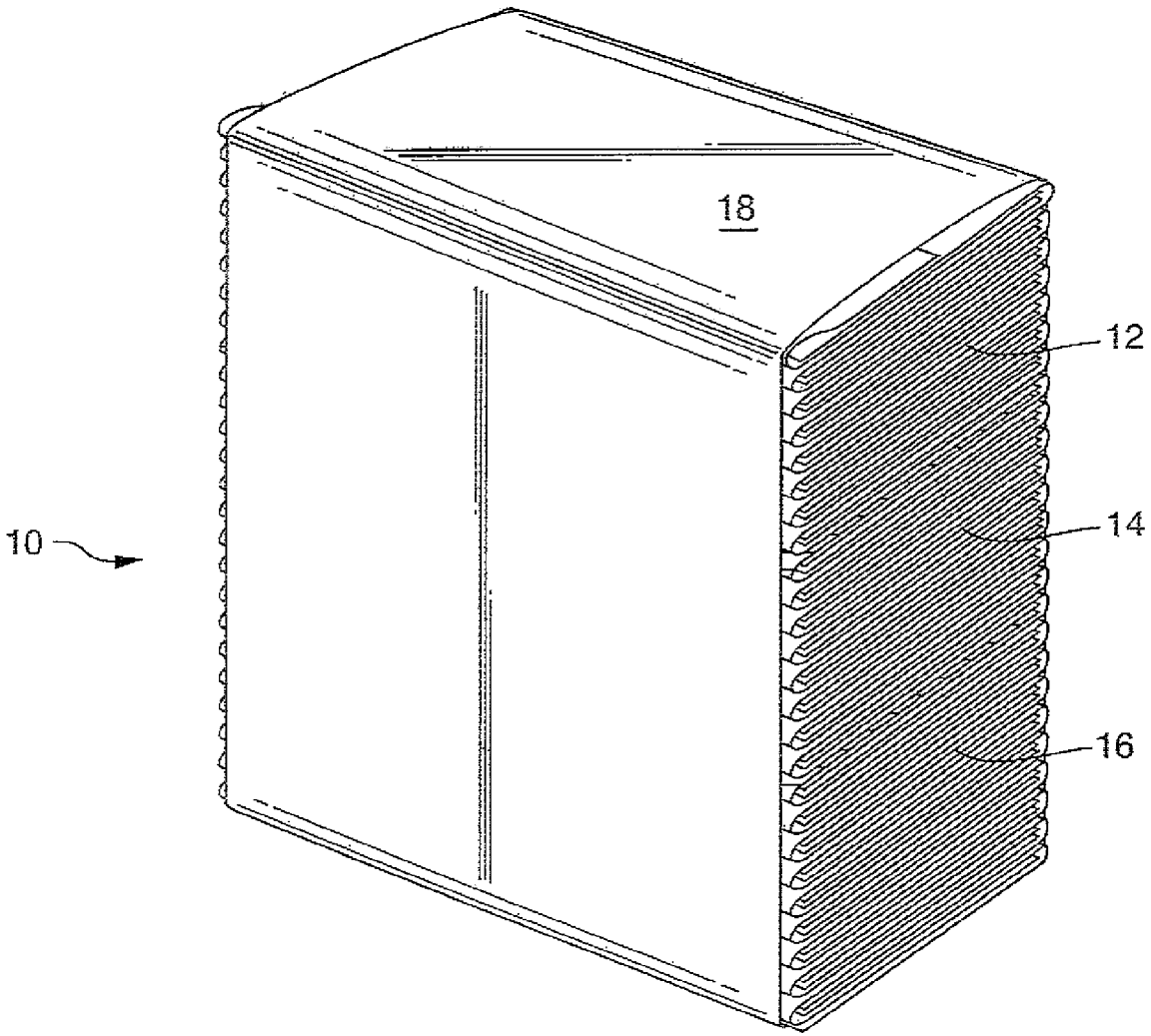
FIG. 1 is a perspective view of one embodiment of a package made in accordance with the present disclosure.

Repeat use of references characters in the present specification and drawings is intended to represent same or analogous features or elements of the invention.

DETAILED DESCRIPTION

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

In general, the present disclosure is directed to a package containing folded sheet refills that are intended to refill an empty carton or dispenser for the product. More particularly, the package contains a plurality of refill cartridges. Each refill cartridge is for refilling a dispenser of the product. Thus, the dispenser can be refilled multiple times by buying a single package.

A package made in accordance with the present disclosure, for instance, may include at least two refill cartridges, such as from about two refill cartridges to about eight refill cartridges. In one embodiment, for instance, three refill cartridges may be stacked together within the package. In order to simplify the product and save cost, each cartridge may not be separately packaged or otherwise wrapped. Instead the three cartridges are intimately stacked together and held together by a packaging material. A separating device may be used to separate the different cartridges within each package. The separating device may be visual and/or mechanical. For instance, in one embodiment, different color sheets may separate the different cartridges. Alternatively, a rigid divider may be used to separate the cartridges.

Packages made in accordance with the present disclosure can offer various advantages and benefits. For instance, tissue sheets can be sold and inserted into previously purchased dispensers which can eliminate the cost of having to repurchase a carton. Tissue cartons made from paperboard, for instance, represent a substantial portion of the costs of a tissue box. By reusing cartons, less paperboard enters the waste stream making the product of the present disclosure environmentally friendly.

Another advantage is that the refill packages may take up at least about 10% less space, such as at least about 20% less space than tissue products packaged in cartons. Sheets within dispensers or cartons are typically not compressed to avoid sheet tearing when the user attempts to remove initial sheets. Thus, refill packages require less shelf space compared to sheet products sold within carton dispensers at the retail outlet where the product is sold. For example, current facial tissues having a stack height density without compression of about 45 sheets per inch of height can be compressed by 20% and packaged with a density of greater than 54 sheets per inch of height. Another advantage to the present disclosure is that the refill packages can be produced by the manufacturer more efficiently and much faster than if each stack of tissue sheets were required to be placed in a carton. Multi-folder systems, such as those disclosed in U.S. Pat. No. 3,066,932 and in U.S. Pat. No. 3,122,361 may operate at much faster speeds with the absence of having to place each stack of tissue sheets in a carton. In particular, the productivity rate of the converting process of packaging the tissue sheets from parent rolls would increase due to the higher number of sheets per package. Higher converting capacity reduces the number of converting lines required for the similar sales volumes. Grade changing delays may also be significantly reduced in the packaging process, since the refill package size can be held constant and the number of refill cartridges per package increased or decreased depending on the individual refill cartridge size.

Referring to FIG. 1, for instance, one embodiment of a package 10 made in accordance with the present disclosure is illustrated. As shown, the package 10 contains a plurality of refill cartridges 12, 14 and 16. Each refill cartridge contains a tissue product. More particularly, each cartridge contains a stack of tissue sheets that are interfolded together. Each refill cartridge, however, is not interconnected in any way to an adjacent cartridge. Each refill cartridge is intended to completely refill a corresponding dispenser, such as a decorative carton having a top opening for dispensing the tissue product one sheet at a time.

The tissue product contained within the packages made according to the present disclosure can vary depending upon the particular application. For example, the tissue product may comprise facial tissues, bath tissues, paper towels, napkins, industrial wipers, and the like.

In general, the tissue sheets contain cellulosic fibers, such as softwood fibers and/or hardwood fibers. The tissue sheets can also contain secondary or recycled cellulosic fibers and mixtures thereof. Especially suitable hardwood fibers include eucalyptus and maple fibers. Softwood fibers particularly well suited for making tissue products include northern softwood kraft fibers. The tissue sheets can contain cellulosic fibers in amount greater than about 50% by weight, such as in an amount greater than about 80% by weight. For instance, in one embodiment, the tissue sheets can contain essentially pulp fibers. In one embodiment, the tissue sheets may also contain synthetic fibers, such as fibers made from a thermoplastic polymer. The tissue sheets, for instance, may contain pulp fibers combined with synthetic fibers. The synthetic fibers may be present in an amount less than about 15% by weight, such as an amount from about 1% to about 10% by weight.

The tissue sheets can be made with a homogeneous fiber furnish or can be formed from a stratified fiber furnish producing layers within each ply. Stratified based webs can be formed using equipment known in the art, such as multilayered head boxes.

Tissue products packaged according to the present disclosure can generally be formed by any of a variety of paper making processes known in the art. In one embodiment, for instance, the tissue sheets can be comprised of wet laid webs. Processes that may be used in forming the tissue sheets include through-air drying, adhesive creping, wet creping, double creping, embossing, wet pressing, air pressing, as well as any other suitable process or technique.

Tissue sheets made in accordance with the present disclosure generally have a bulk of greater than about 3 cc/g, such as from about 5 cc/g to about 15 cc/g. The tissue sheets can be substantially dry, meaning that the tissue sheets only contain ambient moisture.

The number of sheets contained within each refill cartridge can also vary depending upon the particular application. In one embodiment, for instance, each refill cartridge 12, 14 or 16 may contain at least about 50 tissue sheets. For instance, each cartridge may contain from about 60 sheets to about 120 sheets, such as from about 70 sheets to about 100 sheets.

As shown in FIG. 1, the refill cartridges 12, 14 and 16 may be held together by a packaging material 18. The packaging material 18 may comprise a paper including a paperboard, or a plastic film. As shown in FIG. 1, in one embodiment, the packaging material may be in the form of a sleeve or band that is wrapped around the plurality of refill cartridges that have been stacked together. In this embodiment, the packaging material is wrapped around the refill cartridges so as to include an open end on one side and an open end on an opposite side. In an alternative embodiment, however, the refill cartridges may be completely enclosed within the packaging material 18.

As described above, in one embodiment, the packaging material can compress together the tissue sheets. For instance, the packaging material can compress the tissue sheets together such that the compressed stack height is at least about 20% less than the uncompressed stack height. In various embodiments, for instance, the compressed stack height may be at least about 30% less than the uncompressed stack height, at least about 40% less than the uncompressed stack height, and, in one embodiment, even at least about 50% of the uncompressed stack height. In one particular embodiment, for instance, the tissue sheets may be compressed such that the compressed stack height may be from about 30% to about 70% less than the uncompressed stack height.

The amount of force being exerted on the tissue sheets by the packaging materials can vary depending upon the particular application. In one embodiment, for instance, the packaging material may exert a force of greater than about 0.75 pounds per square inch, such as greater than about 1 pound per square inch. For instance, the packaging material may exert a force of from about 0.75 pounds per square inch to about 1.5 pounds per square inch.

In one embodiment, the packaging material 18 may include various printed matter. For instance, the packaging material may include trademark and product information. In addition, the packaging material may include instructions teaching users on how to refill a corresponding dispenser. The printed matter may also include advertising for sheet quality, dispensing benefits, and environmental benefits.

Figure 2:
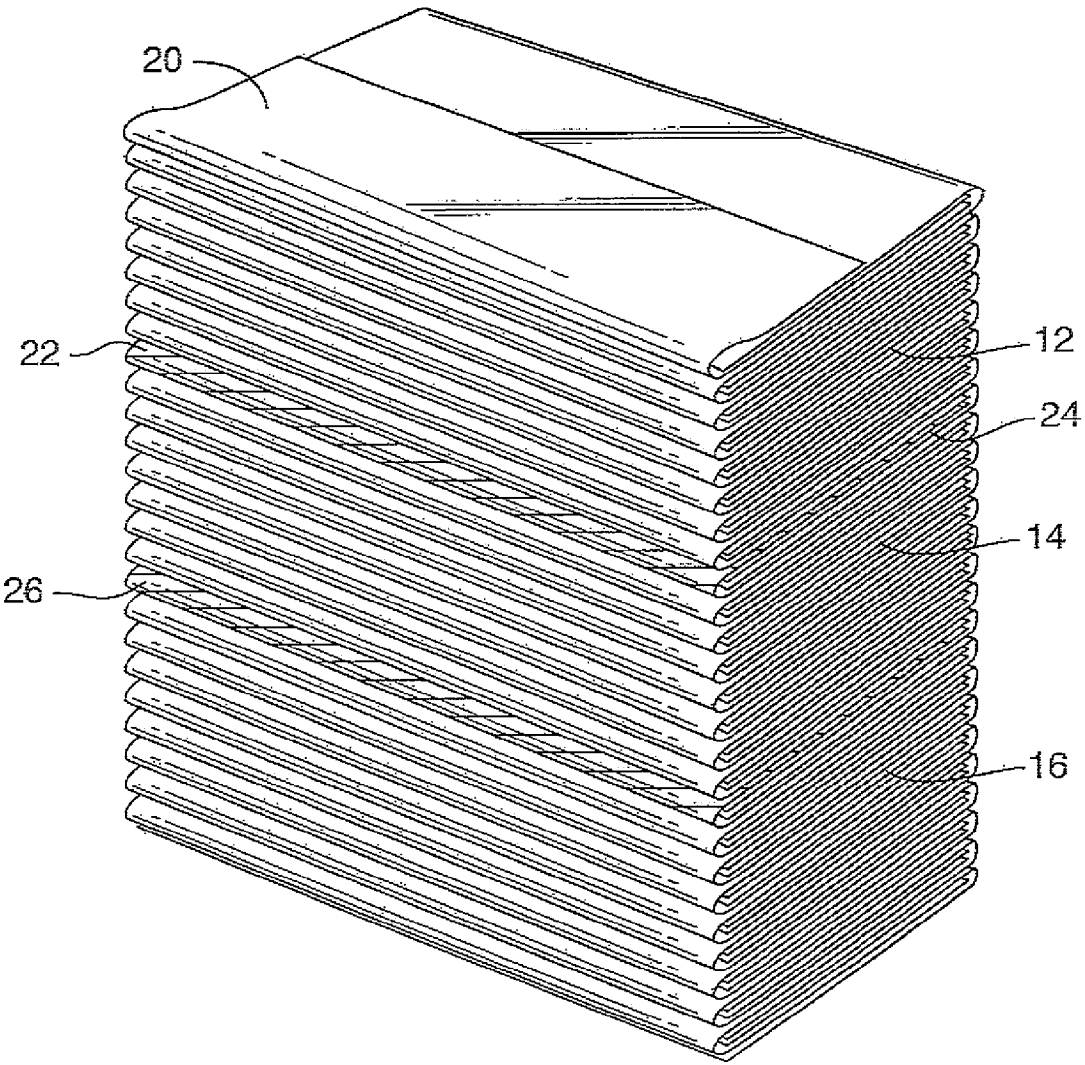
FIG. 2 is a perspective view of three refill cartridges of a tissue product stacked together in accordance with the present disclosure.

Referring to FIG. 2, the plurality of refill cartridges 12, 14 and 16 are shown without the packaging material. In one embodiment, each of the refill cartridges may be separated from each other by a separating device. The separating device, for instance, may comprise a visual indication or may comprise some type of structural element. In the embodiment illustrated in FIG. 2, for instance, color is used as the separating element.

More particularly, the first refill cartridge 12 includes an initial tissue sheet 20 and an ending tissue sheet 22. Similarly, the second refill cartridge 14 includes an initial tissue sheet 24 and an ending tissue sheet 26. As shown, the ending tissue sheet 22 of the refill cartridge 12 is a different color than the initial tissue sheet 24 of the second refill cartridge 14. In this manner, a user can easily discern where the first cartridge ends and the second cartridge begins. Similarly, the ending tissue sheet 26 of the second cartridge 14 may be a different color than the initial tissue sheet of the third refill cartridge 16.

In one embodiment, more than one of the ending sheets of each cartridge may be a different color than the remainder of the stacked sheets contained in the cartridge. The different color in the last several tissue sheets may not only assist in separating the cartridges, but may also provide an indication to the user that the dispenser is almost out of sheets once the cartridge has been loaded in the dispenser. For example, in one embodiment, from about two to about five of the ending tissue sheets of each cartridge may be a different color than the remaining sheets contained in the stack.

Figure 3:
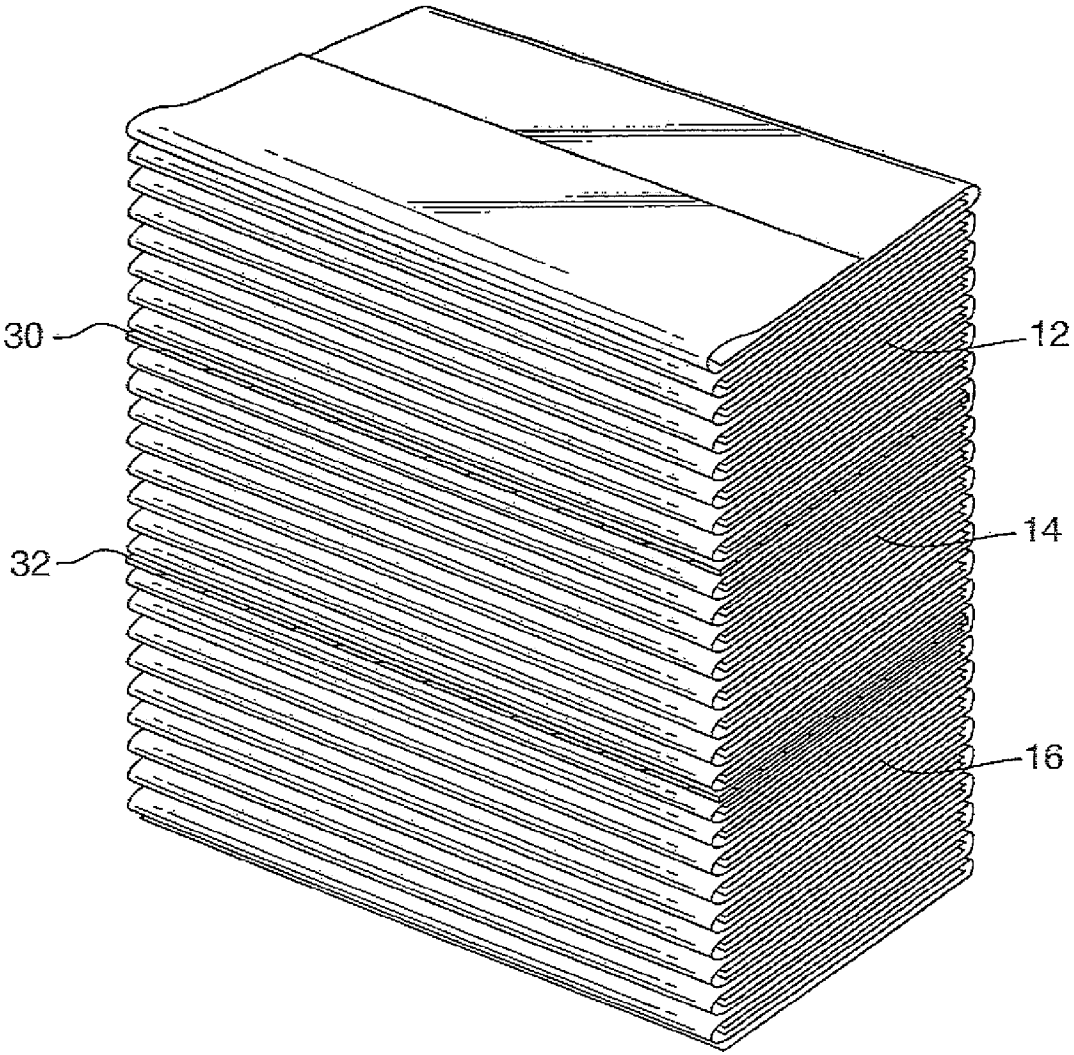
FIG. 3 is a perspective view of another embodiment of three refill cartridges of a tissue product stacked together in accordance in accordance with the present disclosure.

Referring to FIG. 3, an alternative embodiment of a stack of refill cartridges made in accordance with the present disclosure is shown. Like reference numerals have been used to indicate similar elements. In the embodiment illustrated in FIG. 3, the packaging material surrounding the cartridges is not shown for purposes of clarity.

As shown, three refill cartridges 12, 14 and 16 are stacked together. In this embodiment, however, the refill cartridges are separated by a separating device that comprises a rigid panel or tray. For instance, the first refill cartridge 12 is separated from the second refill cartridge 14 by a separating device 30. Likewise, the second refill cartridge 14 is separated from the third refill cartridge 16 by a separating device 32.

The separating devices 30 and 32 may be comprised of any suitable material, such as paperboard or plastic. The separating devices 30 and 32 can generally have the same perimeter shape as the stacked tissue sheets as shown in FIG. 3. Alternatively, the separating devices 30 and 32 may include at least one dimension that is longer or wider than the corresponding dimension of the tissue sheets. For instance, the separating device can have a longer length and a longer width than the stacked tissue sheets as illustrated.

The separating devices 30 and 32 are for use in separating the different cartridges when refilling dispensers. In one embodiment, the separating devices 30 and 32 may have the same length as the tissue sheets but may be wider. In still another embodiment, the separating devices 30 and 32 may be longer than the tissue sheets but have the same width. In yet another embodiment, the separating device may include a tab that projects out from in between the adjacent refill cartridges.

The tissue sheets contained in each refill cartridge can be interfolded together. In this manner, when placed in a dispenser, one tissue sheet can be removed through an opening in the dispenser causing the following tissue sheet to partially extend out through the opening. In this manner, the tissue sheets can be easily dispensed from a dispenser one at a time.

In one embodiment, each refill cartridge can include an initial tissue sheet that includes a starter fold. The starter fold, for instance, may provide a centrally located longitudinally folded edge on the top of each stack that facilitates initial removal of the tissue sheets from a dispenser. Starter fold arrangements are disclosed, for instance, in U.S. Pat. No. 3,679,094 and in U.S. Pat. No. 5,868,276 which are both incorporated herein by reference. Various starter fold arrangements are also illustrated in FIGS. 4 through 6.

Figure 4:
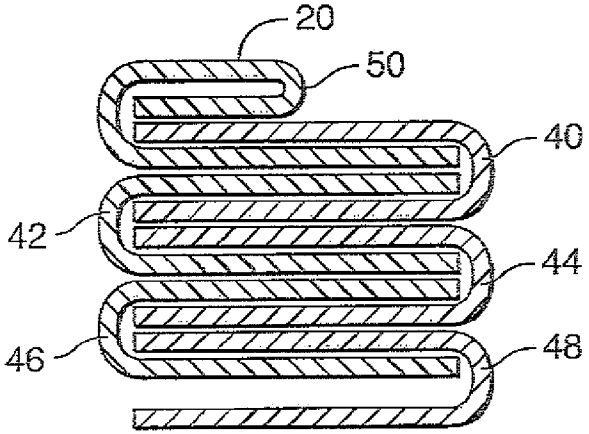
FIG. 4 is a cross-sectional view of one embodiment of a stack of tissue sheets illustrating a starter fold.

Referring to FIG. 4, for instance, the top sheets that may appear in a refill cartridge made according to the present disclosure are shown. In FIG. 4, for instance, an initial tissue sheet 20 is shown overlaying a second tissue sheet 40, a third tissue sheet 42, a fourth tissue sheet 44, a fifth tissue sheet 46, and a sixth tissue sheet 48. As shown, the initial tissue sheet 20 is trifolded while the remaining tissue sheets 40, 42, 44, 46 and 48 are bifolded. More particularly, the initial tissue sheet 20 is folded upon itself at the top of the stack thus providing a longitudinal fold line 50 that allows the user to grasp the initial tissue sheet and begin removing sheets from a dispenser.

Figure 5:
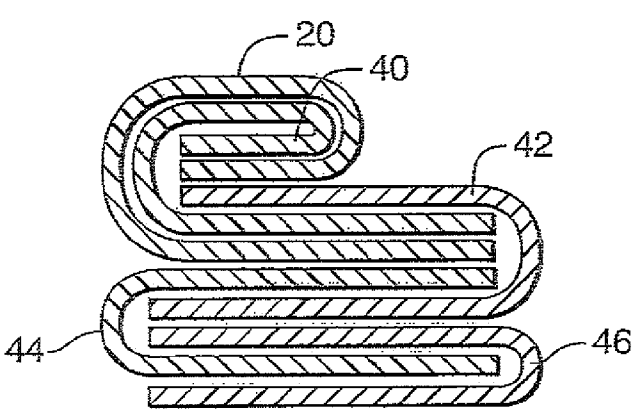
FIG. 5 is a cross-sectional view of a stack of tissue sheets illustrating an alternative embodiment of a starter fold.

Referring to FIG. 5, an alternative embodiment of a starter fold arrangement is shown. In this embodiment, the initial tissue sheet 20 and the second tissue sheet 40 have a trifold arrangement. The remaining tissue sheets 42, 44 and 46, on the other hand, are in a bifold arrangement. In the embodiment illustrated in FIG. 5, the first tissue sheet 20 and the second tissue sheet 40 are initially removed from the dispenser causing the third tissue sheet 42 to be partially withdrawn through an opening for later use.

Figure 6:
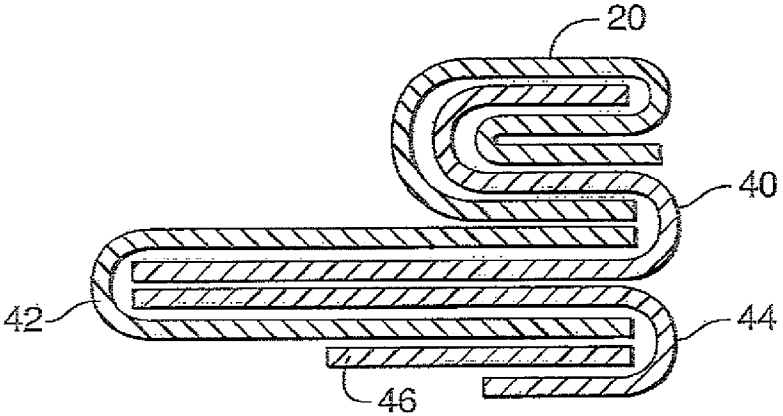
FIG. 6 is a cross-sectional view of a stack of tissue sheets illustrating still another embodiment of a starter fold.

Still another embodiment of a starter fold arrangement is illustrated in FIG. 6. In the embodiment illustrated in FIG. 6, the initial tissue sheet 20 is quadfolded meaning that the tissue sheet is folded into four separate panels. The second tissue sheet 40, on the other hand, is trifolded while the remaining tissue sheets in the stack including tissue sheets 42, 44 and 46 are bifolded.

It should be understood, however, that any suitable folding arrangement may be used to construct the refill cartridges.

Figure 7:
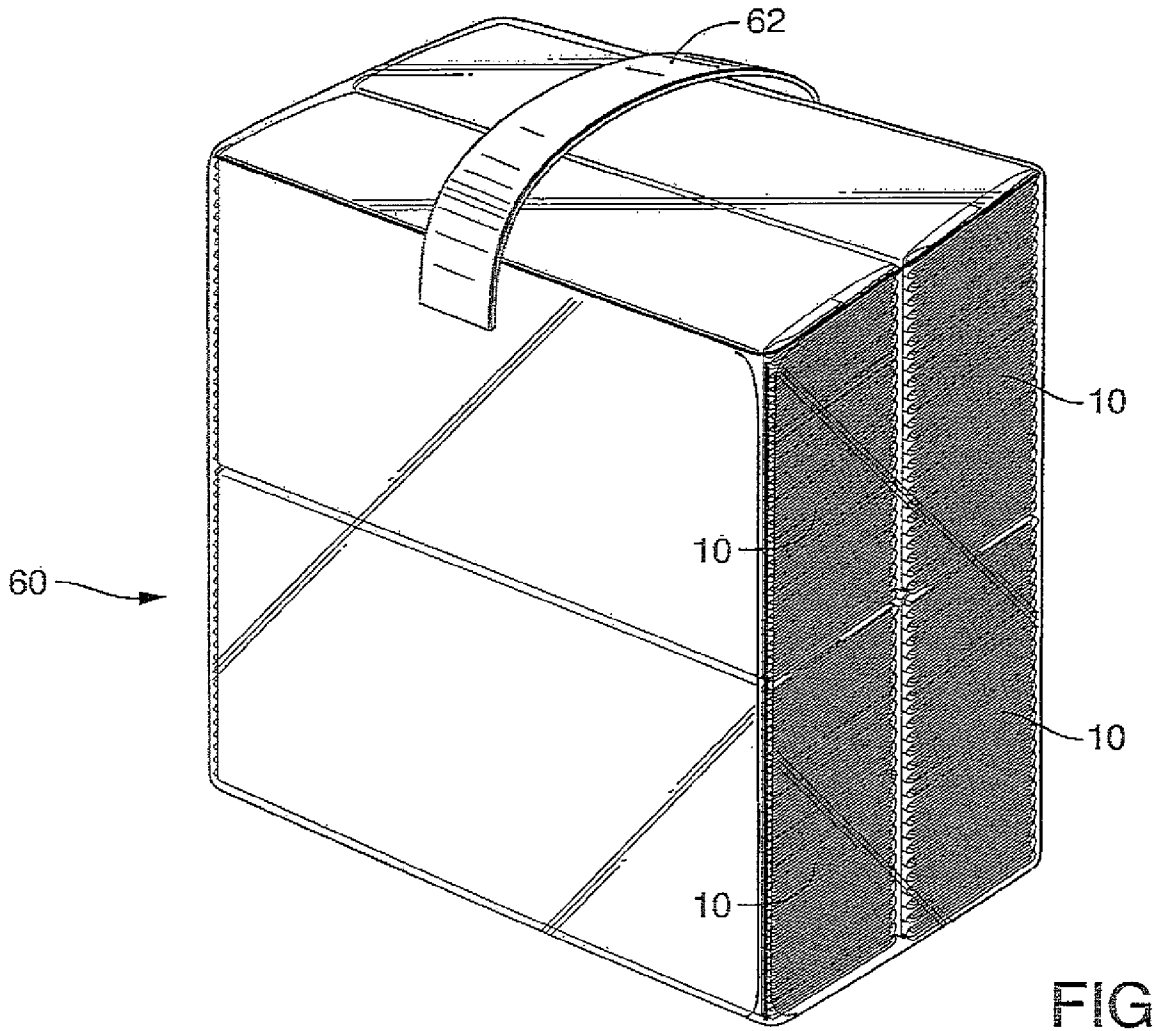
FIG. 7 is a perspective view of a bundle pack made in accordance with the present disclosure that contains several of the packages illustrated in FIG. 1.

In one embodiment, the package of the present disclosure can be sold in single units as shown in FIG. 1. As described above, each package contains a plurality of refill cartridges stacked together. In an alternative embodiment, the package as shown in FIG. 1 can be placed into a larger package and sold in bulk form. One embodiment of a bulk package 60 is shown in FIG. 7. In this embodiment, four packages 10 as shown in FIG. 1 are contained in a larger package 60. The larger package 60 is made from a polymer film and completely encloses the four smaller packages. The package 60 can include a handle 62 for easy transport.

In the embodiment illustrated in FIG. 7, the larger package 60 contains twelve refill cartridges. Of particular advantage, the refill cartridges can be contained in a package that has a substantially reduced volume in comparison to buying twelve cartons of facial tissues as provided in the past.

The refill cartridges in accordance with the present disclosure can be used to refill any suitable tissue dispenser. For example, refillable dispensers that may be used in conjunction with the refill cartridges are described in U.S. Pat. Nos. 7,377,391; 5,746,318; 5,622,281; and U.S. Pat. No. 5,540,354, which are all incorporated herein by reference.

Figure 8:
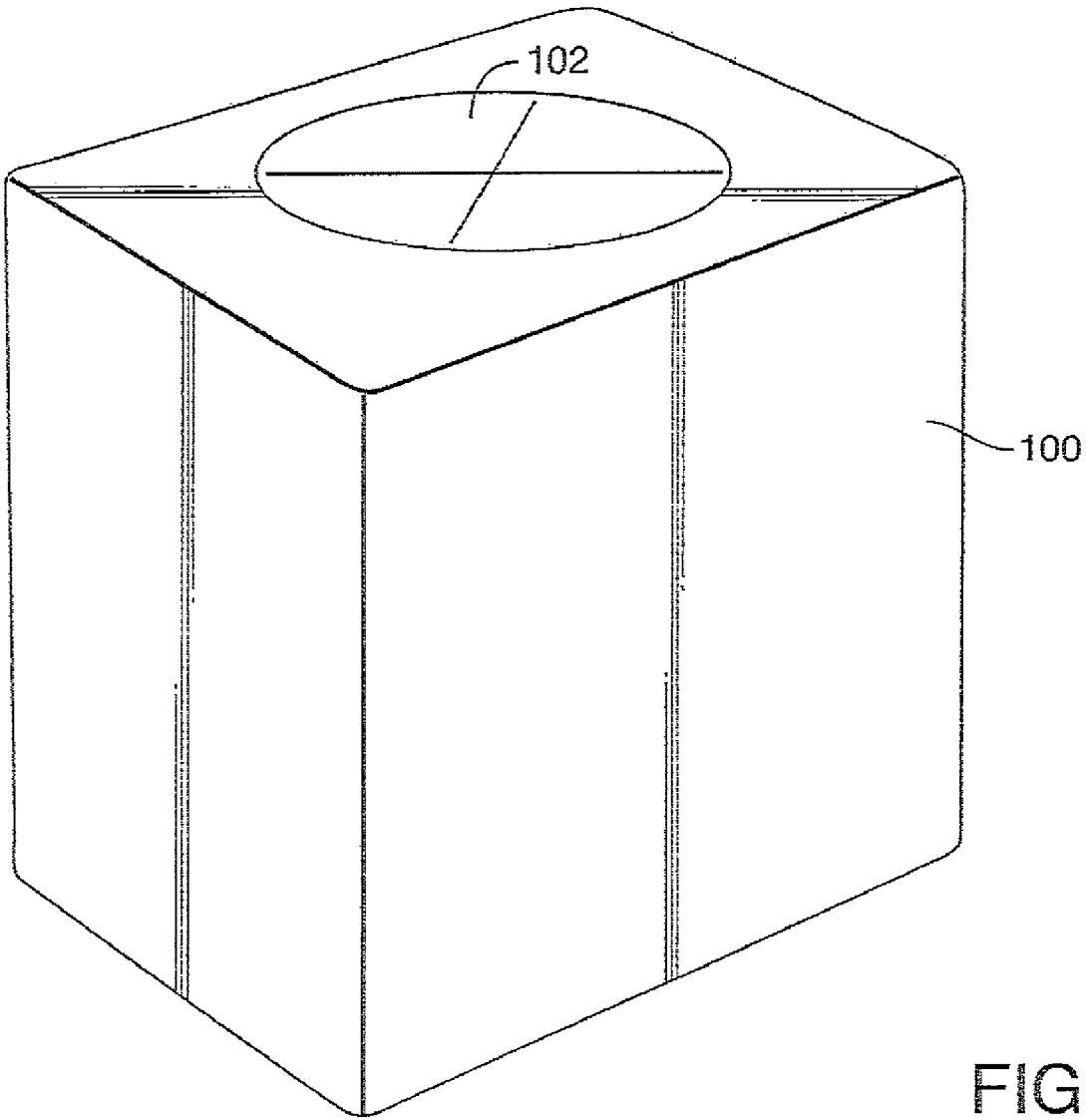
FIG. 8 is one embodiment of a dispenser that can be used in conjunction with the tissue product of the present disclosure.
Figure 9:
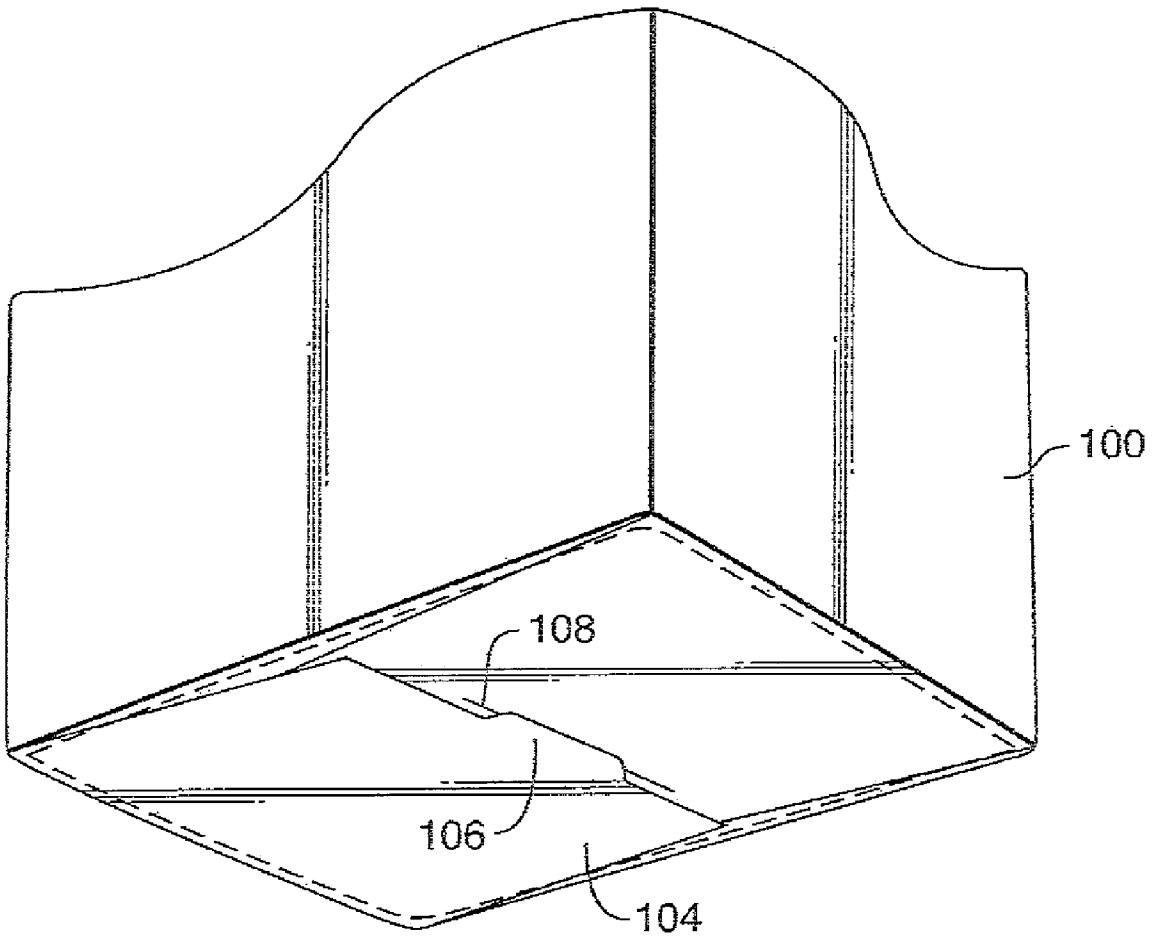
FIG. 9 is a perspective view with cutaway portions of the bottom of the dispenser illustrated in FIG. 8.

One exemplary dispenser that may be used in conjunction with the refill cartridges is illustrated in FIGS. 8 and 9. As shown, the dispenser 100 generally comprises an upright dispenser that includes an opening 102 for dispensing the tissue sheets one at a time. The stack of tissue sheets, for instance, may be contained within the dispenser 100 in a C-clip arrangement.

As shown in FIG. 9, the dispenser 100 includes a bottom 104 that is designed to be opened and closed. The bottom 104, for instance, can be opened and closed by using a closing tab 106 on one major bottom flap and a tab slot 108 on the opposing major bottom flap. This allows for the dispenser to be refilled with new sheet material when depleted.

These and other modifications and variations to the present disclosure may be practiced by those of ordinary skill in the art, without departing from the spirit and scope of the present disclosure, which is more particularly set forth in the appended claims. In addition, it should be understood that aspects of the various embodiments may be interchanged either in whole or in part. Furthermore, those of ordinary skill in the art will appreciate that the foregoing description is by way of example only, and is not intended to limit the disclosure so further described in such appended claims.

What is claimed is:

1. A package of refill folded sheets comprising:

a plurality of refill cartridges of a folded sheet product, the folded sheet product comprising individual sheets, each refill cartridge including a stack of folded sheets that are interfolded together, the plurality of refill cartridges being stacked together, each refill cartridge being separated from an adjacent cartridge by a separating device such that each separating device is positioned only at a boundary of adjacent refill cartridges and is free from contact with any other separating device, and wherein the plurality of refill cartridges are surrounded by a packaging material wherein the packaging material surrounds and binds together the plurality of refill cartridges and the separating devices such that the refill cartridges are free of individual packaging or wrapping such that the packaging material has a first open end opposite a second open end.

2. A package as defined in claim 1, wherein the bottom sheet of each refill cartridge is not interfolded, glued, or otherwise attached to the initial sheet of a different refill cartridge located within the package.

3. A package as defined in claim 1, wherein the initial sheet of each refill cartridge includes a starter fold.

4. A package as defined in claim 3, wherein the starter fold comprises a trifold.

5. A package as defined in claim 1, wherein the separating device comprises color such that at least one end sheet of one refill cartridge is different in color than at least one beginning sheet of an adjacent cartridge.

6. A package as defined in claim 1, wherein the separating device comprises a rigid member positioned in between the adjacent cartridges.

7. A package as defined in claim 6, wherein the rigid member is made from a paperboard.

8. A package as defined in claim 6, wherein the sheets in each cartridge define a perimeter and wherein the separating device comprises a tray that extends beyond the perimeter of the sheets.

9. A package as defined in claim 1, wherein the separating device includes an anti-viral component.

10. A package as defined in claim 1, wherein the package contains from three refill cartridges to five refill cartridges.

11. A package as defined in claim 1, wherein the folded product comprises facial tissues.

12. A package as defined in claim 1, wherein the packaging material that surrounds the plurality of cartridges comprises a polymer film.

13. A package as defined in claim 1, wherein the packaging material that surrounds the plurality of cartridges is in the shape of a band having a first open end opposite a second open end.

14. A package as defined in claim 13, wherein the band is made from a paper or a polymer film.

15. A package as defined in claim 1, wherein the sheets contain pulp fibers in the amount of at least 50% by weight and have a bulk of at least 3 cc/g.

16. A package as defined in claim 1, wherein the folded product comprises a dry product.

17. A package as defined in claim 1, wherein each refill cartridge contains at least 50 individual sheets.

18. A bundle of refill cartridges of a tissue product comprising:

a plurality of packages as defined in claim 1 contained in a larger package, the larger package comprising a flexible polymer film.

19. A bundle of refill cartridges as defined in 18, wherein the larger package contains four of the packages defined in claim 1.

20. A package as defined in claim 1, where at least the last three sheets in the stack of each refill cartridge are a different color than the remaining sheets in the stack.

21. A package as defined in claim 1, wherein the packaging material applies a compressive force on the refill cartridges such that the refill cartridges have a compressed height that is at least 20% less than an uncompressed height.

22. A package as defined in claim 1, wherein the packaging material applies a compressive force on the refill cartridges such that the refill cartridges have a compressed height that is at least 40% less than an uncompressed height.

23. A package of refill folded sheets comprising:

a plurality of refill cartridges of folded sheet product, the product comprising individual sheets, the product comprising a substantially dry product, each refill cartridge including a stack of sheets that are interfolded together, each stack including an initial sheet that includes a starter fold, each refill cartridge not being separately wrapped, the plurality of refill cartridges being stacked together, each refill cartridge being separated from an adjacent cartridge by a separating device such that each separating device is positioned only at a boundary of adjacent refill cartridges and is free from contact with any other separating device, and wherein the plurality of refill cartridges are held together by a packaging material such that the packaging material has a first open end opposite a second open end.

* * * * *